US008714673B2

(12) United States Patent
Kim et al.

(10) Patent No.: US 8,714,673 B2
(45) Date of Patent: May 6, 2014

(54) REFRIGERATOR DOOR AND REFRIGERATOR HAVING THE SAME

(75) Inventors: Ji Man Kim, Gwangju-si (KR); Sang Gyu Jung, Gwangju-si (KR); Hyoung Suk Lee, Daejeon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 495 days.

(21) Appl. No.: 12/964,276

(22) Filed: Dec. 9, 2010

(65) Prior Publication Data

US 2011/0132025 A1 Jun. 9, 2011

(30) Foreign Application Priority Data

Dec. 9, 2009 (KR) ..... 10-2009-121837

(51) Int. Cl.
*A47B 96/00* (2006.01)

(52) U.S. Cl.
USPC ..... 312/405

(58) Field of Classification Search
CPC ..... F25D 23/028
USPC ..... 312/401, 405, 405.1, 109, 204; 62/449
See application file for complete search history.

(56) References Cited

U.S. PATENT DOCUMENTS

2008/0143227 A1* 6/2008 Kim et al. ..... 312/405
2010/0031580 A1* 2/2010 Lee et al. ..... 49/504

FOREIGN PATENT DOCUMENTS

JP 5-126461 5/1993
KR 10-2007-0121277 12/2007
KR 10-2009-0090518 8/2009

* cited by examiner

*Primary Examiner* — James O Hansen
(74) *Attorney, Agent, or Firm* — Staas & Halsey LLP

(57) ABSTRACT

Disclosed herein are a refrigerator door having an improved configuration to prevent damage to a printed layer of a door front panel and a refrigerator having the same. The refrigerator includes a door to open and close a storage compartment. The door includes a front panel on a rear surface of which a printed layer is formed, a door sash coupled to the front panel and having at least one opening, and a foamed material charged in a space defined by the front panel and the door sash. The front panel includes a release layer formed on a surface of the printed layer to correspond to the contour of the at least one opening.

13 Claims, 9 Drawing Sheets

REFRIGERATOR DOOR AND REFRIGERATOR HAVING THE SAME

CROSS-REFERENCE TO RELATED APPLICATIONS

This application claims the benefit of Korean Patent Application No. 2009-0121837, filed on Dec. 9, 2009 in the Korean Intellectual Property Office, the disclosure of which is incorporated herein by reference.

BACKGROUND

1. Field

Example embodiments relate to a refrigerator door which prevents damage to a front panel thereof and a refrigerator having the same.

2. Description of the Related Art

A refrigerator is an apparatus used to keep food fresh for long periods of time by supplying cold air produced by a refrigeration cycle into a storage compartment.

A general refrigerator includes a plurality of storage compartments separated from one another, and doors to open and close the storage compartments.

Recently, designs as well as functions of refrigerators are becoming important factors in purchase decisions and thus, refrigerators having various colors, textures, patterns, etc. have been developed. As a representative example, a front exterior appearance of a refrigerator door is defined by a reinforced glass panel on which various colors and patterns are printed.

However, a printed layer provided at a rear surface of the reinforced glass panel may peel off as a result of a foamed material charged in the interior of the door.

SUMMARY

Therefore, it is an aspect of the example embodiments to provide a refrigerator door having an improved configuration to prevent damage to a printed layer of a door front panel and a refrigerator having the same.

The foregoing and/or other aspects are achieved by providing a refrigerator including a body having a storage compartment defined therein, and a door to open and close the storage compartment, wherein the door includes a front panel on a rear surface of which a printed layer is formed, a door sash coupled to the front panel and having at least one opening, and an inner shell defining a part of an inner wall of the storage compartment, wherein a foamed material is charged in a space defined by the front panel, the door sash, and the inner shell, and wherein the front panel includes a release layer formed on a surface of the printed layer to correspond to the contour of the at least one opening.

The release layer may include a silicon printed portion.

The release layer may be provided in and around a rim of the at least one opening.

The door sash may contain at least one of acrylonitrile butadiene styrene (ABS) copolymer and aluminum.

The foamed material may be formed by foaming a urethane solution.

The front panel may contain at least one of reinforced glass and plastic.

The storage compartment may include a first storage compartment as an upper storage compartment and a second storage compartment as a lower storage compartment, and the door may include a first door to open and close the first storage compartment and a second door to open and close the second storage compartment.

The foregoing and/or other aspects are achieved by providing a refrigerator door to open and close a storage compartment including a front panel on a rear surface of which a printed layer is formed, and a door sash coupled to the front panel and having a plurality of openings, and an inner shell defining a part of an inner wall of the storage compartment, wherein a foamed material is charged in a space defined by the front panel, the door sash and the inner shell, and wherein the front panel includes a release layer formed on a surface of the printed layer to prevent the printed layer from being peeling off caused by the foamed material.

The release layer may contain silicon.

The release layer may be provided in and around a rim of each of the plurality of openings.

The door sash may contain at least one of acrylonitrile butadiene styrene (ABS) copolymer and aluminum.

The foamed material may be formed by foaming a urethane solution.

The front panel may contain at least one of reinforced glass and plastic.

Additional aspects and/or advantages will be set forth in part in the description which follows and, in part, will be apparent from the description, or may be learned by practice of the disclosure.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
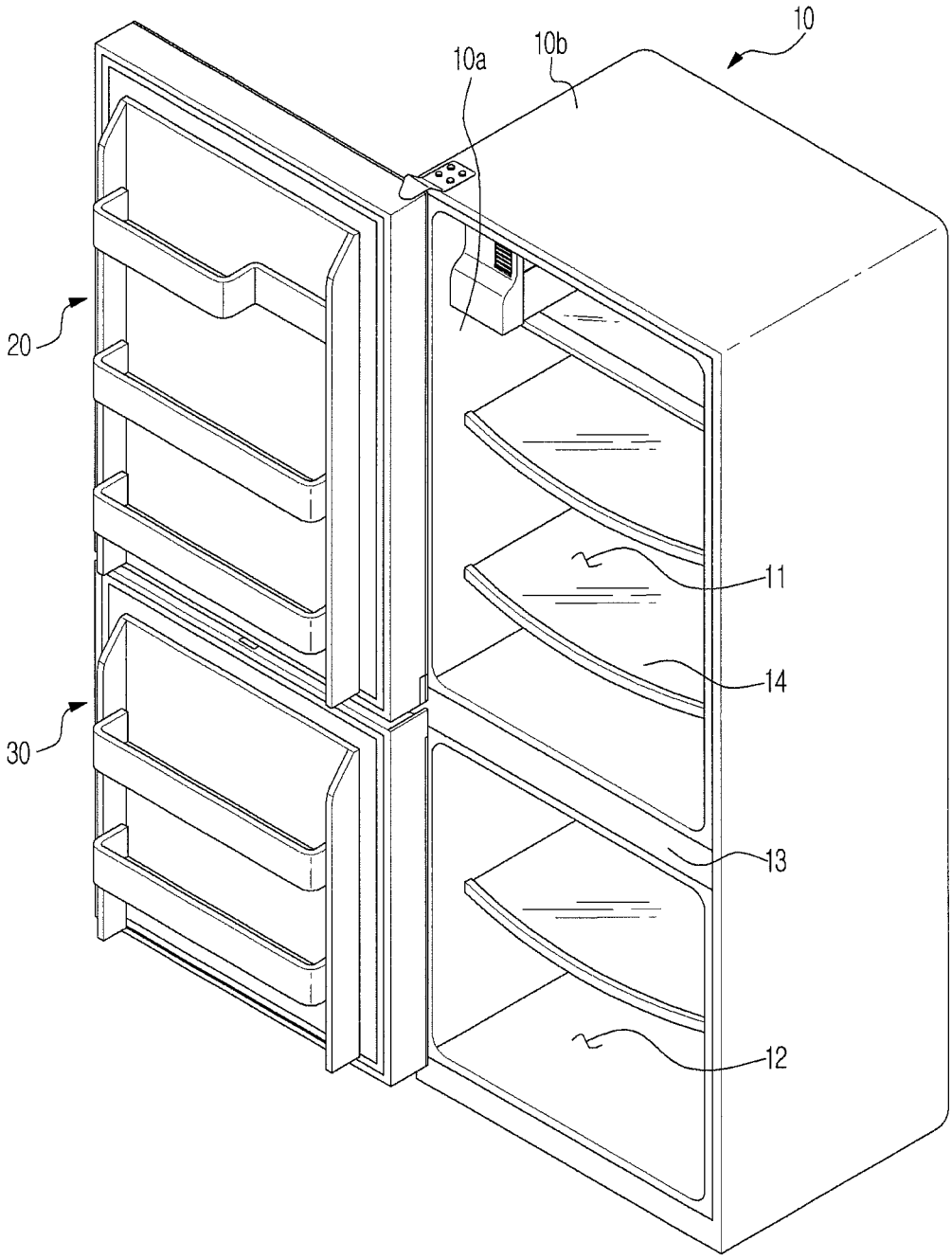
FIG. 1 is a perspective view illustrating an exterior appearance of a refrigerator in a door open state according to example embodiments.

Reference will now be made in detail to the embodiments, examples of which are illustrated in the accompanying drawings, wherein like reference numerals refer to like elements throughout. The embodiments are described below to explain the present disclosure by referring to the figures.

Figure 2:
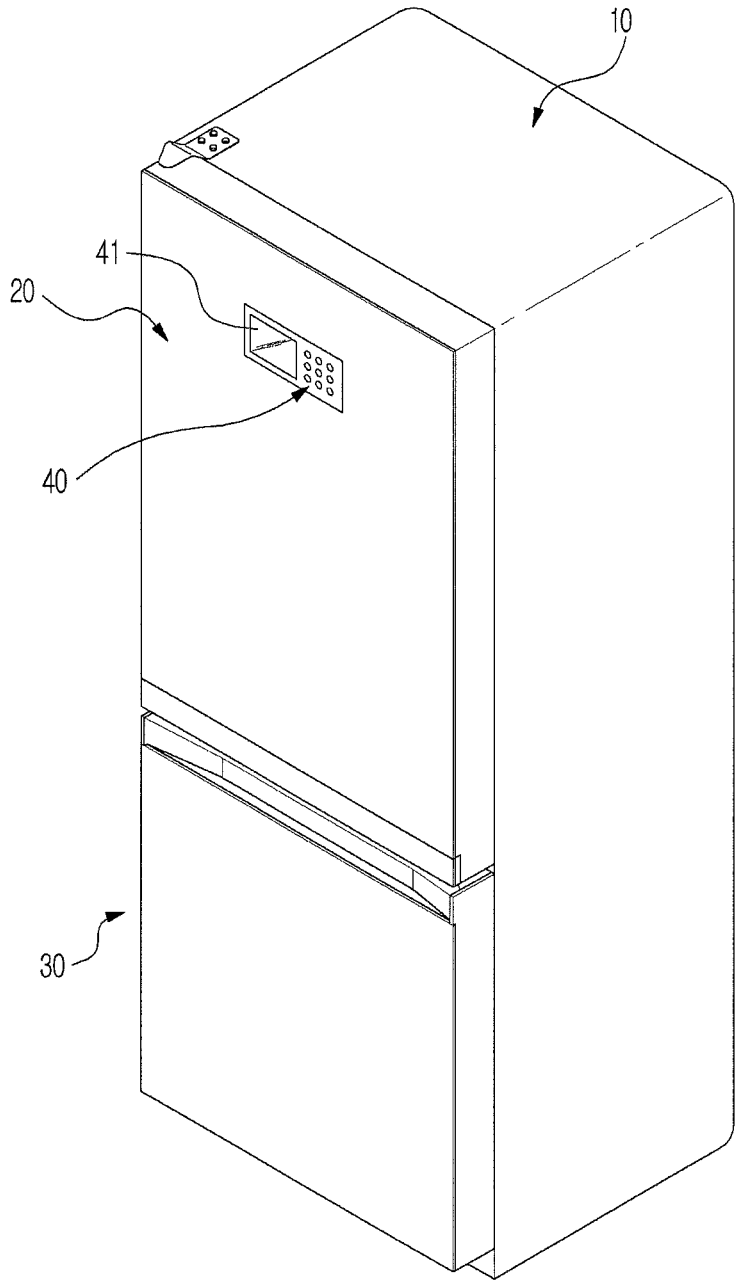
FIG. 2 is a perspective view illustrating an exterior appearance of the refrigerator in a door closed state according to example embodiments.

FIG. 1 is a perspective view illustrating an exterior appearance of a refrigerator in a door open state according to example embodiments, and FIG. 2 is a perspective view illustrating an exterior appearance of the refrigerator in a door closed state according to example embodiments.

As illustrated in FIGS. 1 and 2, the refrigerator includes a body 10 in which a first storage compartment 11 and a second storage compartment 12 are defined to be vertically separated from each other, a first storage compartment door 20 hingedly coupled to the body 10 to open and close an open front surface of the first storage compartment 11, and a second storage compartment door 30 hingedly coupled to the body 10 to open and close an open front surface of the second storage compartment 12.

The refrigerator according to example embodiments is a bottom mounted freezer (BMF) type refrigerator. In other words, the refrigerator may include an upper storage compartment, i.e. the first storage compartment 11 functioning as a refrigerating compartment and a lower storage compartment, i.e. the second storage compartment 12 functioning as a freezing compartment, although interior temperatures of the first storage compartment 11 and the second storage compartment 12 may be adjusted. Also, instead of hinge type doors to open and close the first storage compartment 11 and the second storage compartment 12, a drawer may be pushed into or pulled out of the first storage compartment 11 or the second storage compartment 12. There is no limit to the shape and number of doors. In addition, the number of the storage compartments is not limited to two.

The body 10 contains an insulation partition 13 to separate the first storage compartment 11 and the second storage compartment 12 from each other. The body 10 may include an inner shell 10*a*, an outer shell 10*b*, and a foamed material (not shown) charged between the inner shell 10*a* and the outer shell 10*b*. In this case, the insulation partition 13 is integrally formed with the body 10, thereby achieving improved insulation efficiency between the respective storage compartments. Reference numeral 14 represents a shelf fit into the body 10 for accommodation of stored food.

The first storage compartment 11 and the second storage compartment 12 defined in the body 10 provide independent storage spaces, and storage temperatures of these storage compartments 11 and 12 are independently controlled according to the quantity of cold air supplied into the storage compartments 11 and 12.

The refrigerator further includes an operating unit 40 to operate a variety of functions of the refrigerator (e.g., storage time and storage temperature). The operating unit 40 is located at an upper front surface of the first storage compartment door 20 and includes a display 41. A user may confirm input information and a present status of the refrigerator via the display 41. As an example, the operating unit 40 may be of a touch screen type.

The refrigerator may include an evaporator, a compressor, an expander and a condenser, which provide a refrigeration cycle. Cold air produced by the refrigeration cycle is guided into the interiors of the respective storage compartments through cold air feed paths defined in rear walls of the storage compartments. The configuration of the refrigeration cycle is a generally known and thus, description thereof will be omitted herein.

Hereinafter, the interior configuration of the storage compartment doors 20 and 30 will be described.

Figure 3:
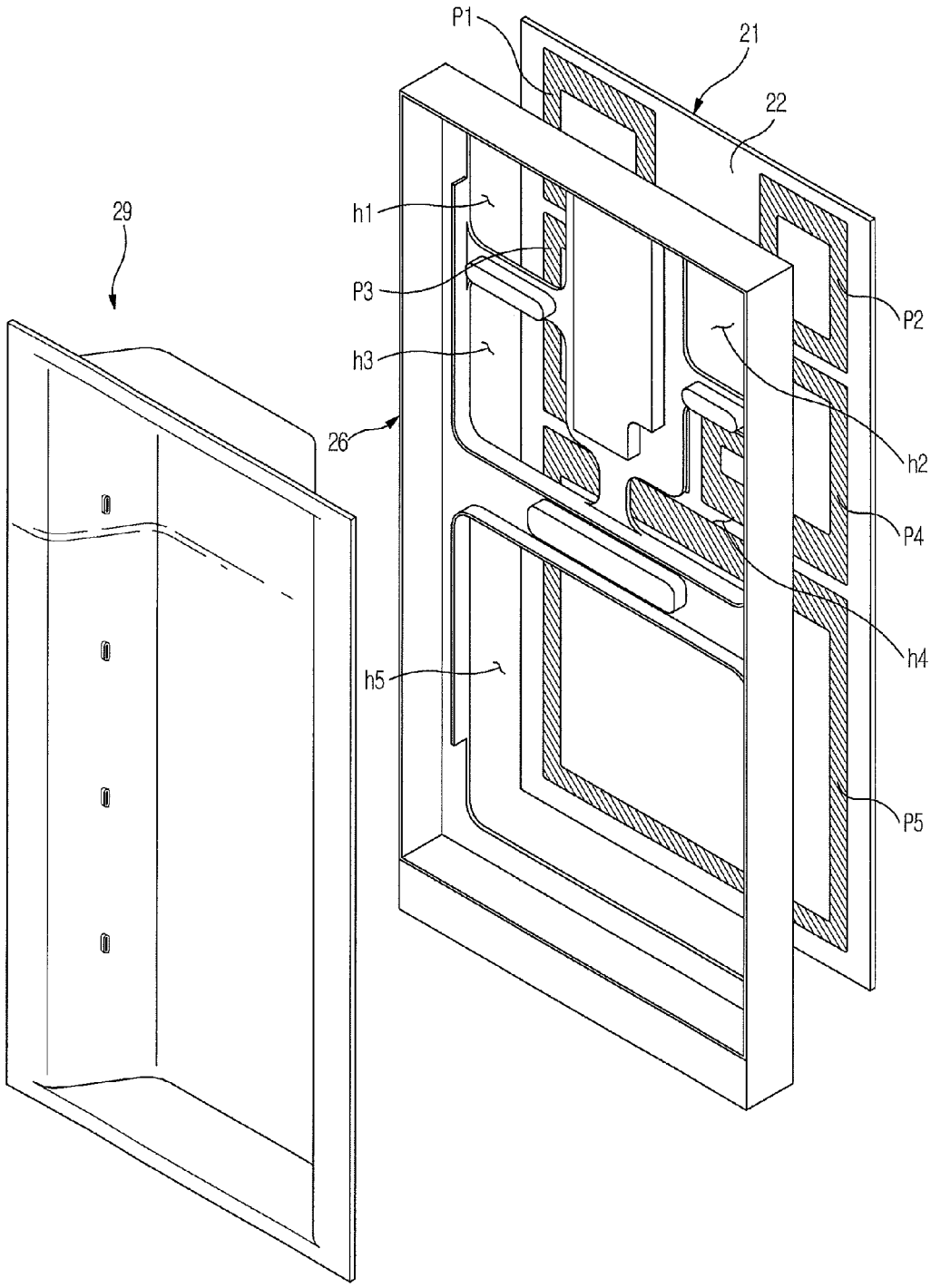
FIG. 3 is a perspective view illustrating a coupling relationship between a front panel and a door sash of a first storage compartment door according to example embodiments.
Figure 4A:
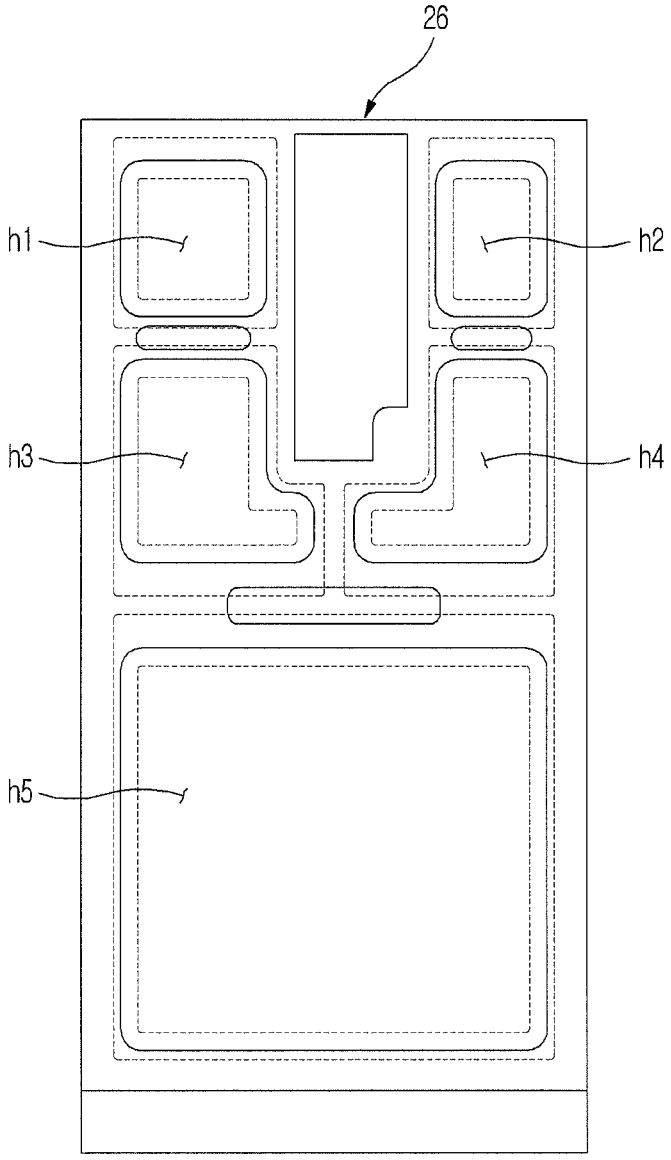
FIG. 4A is a front view of FIG. 3.
Figure 4B:
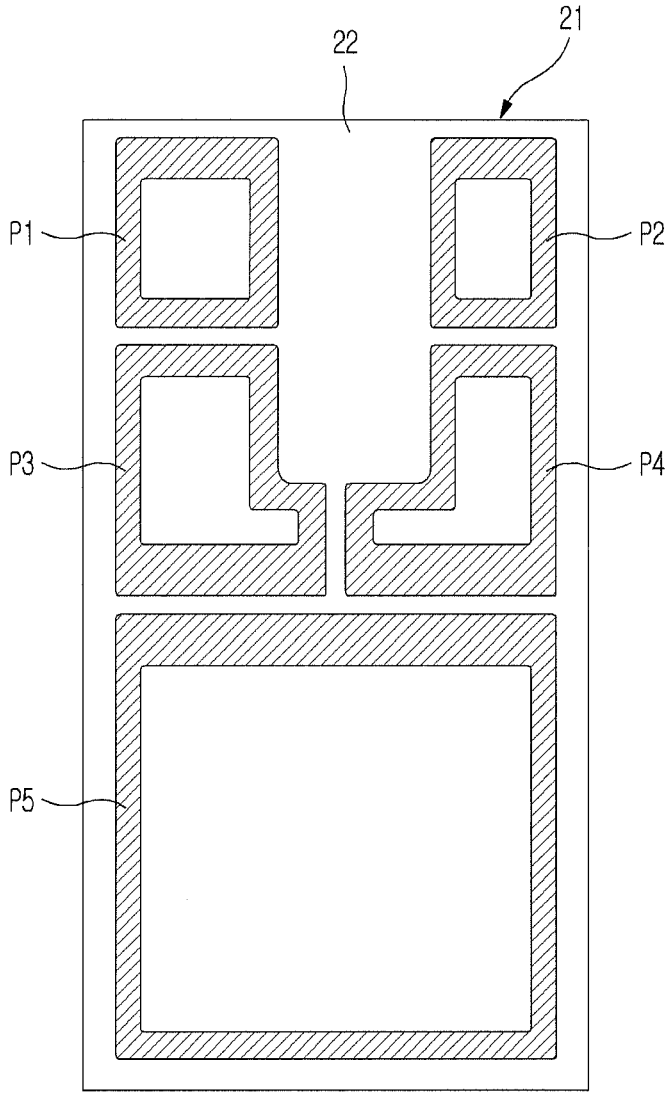
FIG. 4B is a view illustrating a release layer formed at the front panel of FIG. 4A.
Figure 5:
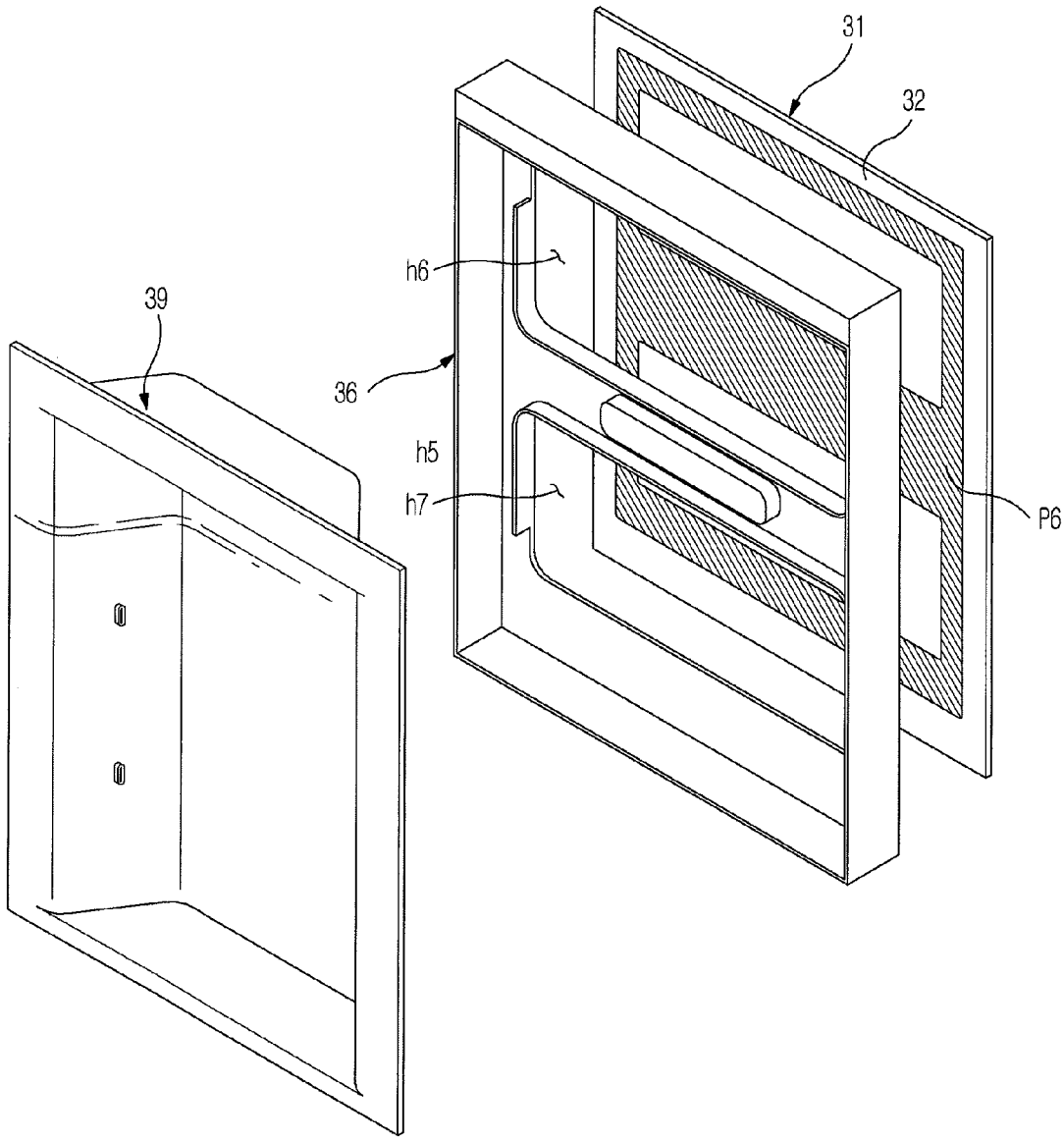
FIG. 5 is a perspective view illustrating a coupling relationship between a front panel and a door sash of a second storage compartment door according to example embodiments.
Figure 6A:
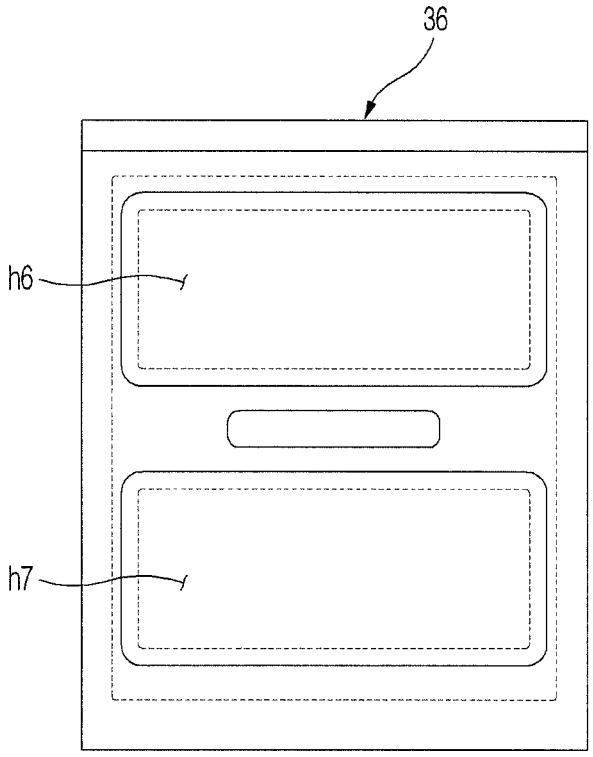
FIG. 6A is a front view of FIG. 5.
Figure 6B:
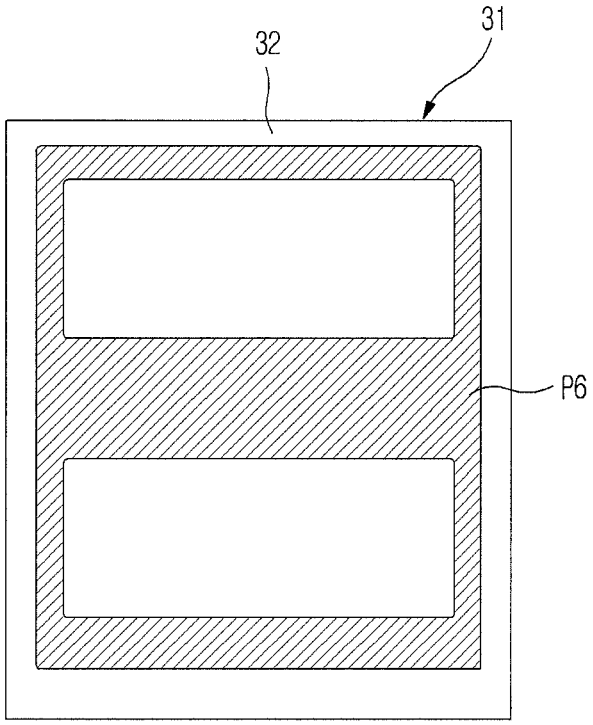
FIG. 6B is a view illustrating a release layer formed at the front panel of FIG. 6A.

FIG. 3 is a perspective view illustrating a coupling relationship between a front panel and a door sash of the first storage compartment door according to example embodiments. FIG. 4A is a front view of FIG. 3, and FIG. 4B is a view illustrating a release layer formed at the front panel of FIG. 4A. FIG. 5 is a perspective view illustrating a coupling relationship between a front panel and a door sash of the second storage compartment door according to example embodiments. FIG. 6A is a front view of FIG. 5, and FIG. 6B is a view illustrating a release layer formed at the front panel of FIG. 6A.

Referring to FIGS. 3, 4A and 4B, the first storage compartment door 20 includes a first front panel 21 defining a front exterior appearance, a first door sash 26 coupled to the first front panel 21, and a first inner shell 29 defining a part of an inner wall of the first storage compartment 11.

The first front panel 21 may be made of reinforced glass or plastic and a printed layer 22 may be formed on the entire rear surface of the first front panel 21.

The printed layer 22 provides the first front panel 21 with various colors and patterns when viewed from the front side, and which may be aesthetically pleasing to the user.

The first door sash 26 is coupled to the first front panel 21 by use of a double sided tape (not shown) and defines a framework of the first storage compartment door 20. One or more openings h1, h2, h3, h4 and h5 are perforated in different positions of the first door sash 26. These openings h1, h2, h3, h4 and h5 may have various shapes, such as, e.g., circular and rectangular shapes.

The first door sash 26 may be made of acrylonitrile butadiene styrene (ABS) copolymer, or aluminum.

The first front panel 21 includes release layers P1, P2, P3, P4 and P5 formed on a surface of the printed layer 22 to correspond to the contours of the openings h1, h2, h3, h4 and h5.

The respective release layers P1, P2, P3, P4 and P5 are formed by printing silicon, to correspond to the contours of the openings h1, h2, h3, h4 and h5 when coupled to the first door sash 26.

Specifically, the respective release layers P1, P2, P3, P4 and P5 cover around the rims of the respective openings h1, h2, h3, h4 and h5. The release layers P1, P2, P3, P4 and P5 are silicon printed layers.

The release layers P1, P2, P3, P4 and P5 act to prevent peeling of the printed layer 22 caused when the foamed material invades the rims of the openings h1, h2, h3, h4 and h5. The principle of preventing the peeling phenomenon will be described hereinafter.

Referring to FIGS. 5, 6A and 6B, the second storage compartment door 30 includes a second front panel 31 defining a front exterior appearance, a second door sash 36 coupled to the second front panel 31, and a second inner shell 39 defining a part of an inner wall of the second storage compartment 12.

The second front panel 31 is made of reinforced glass or plastic, and a printed layer 32 is formed on the entire rear surface of the second front panel 31.

The printed layer 32 is provided for aesthetics, and expresses various colors and patterns related to the printed layer 22 of the first front panel 21.

The second door sash 36 defines a framework of the second storage compartment door 30, and one or more openings h6 and h7 are perforated in different positions of the second door sash 36.

The second door sash 36 may be made of acrylonitrile butadiene styrene (ABS) copolymer or aluminum, in the same manner as the first door sash 26.

The second front panel 31 includes a release layer P6 formed on a surface of the printed layer 32 to correspond to the contour of the second door sash 36.

The release layer P6 is formed by printing silicon to correspond to the contours of the openings h6 and h7 when coupled to the second door sash 36. The release layer P6 may correspond to a projected figure of the second door sash 36. In the same manner as the first front panel 21, the release layer P6 is configured to cover around the rims of the openings h6 and h7.

Hereinafter, the peeling prevention principle using the release layers P1, P2, P3, P4, P5 and P6 will be described.

Figure 7:
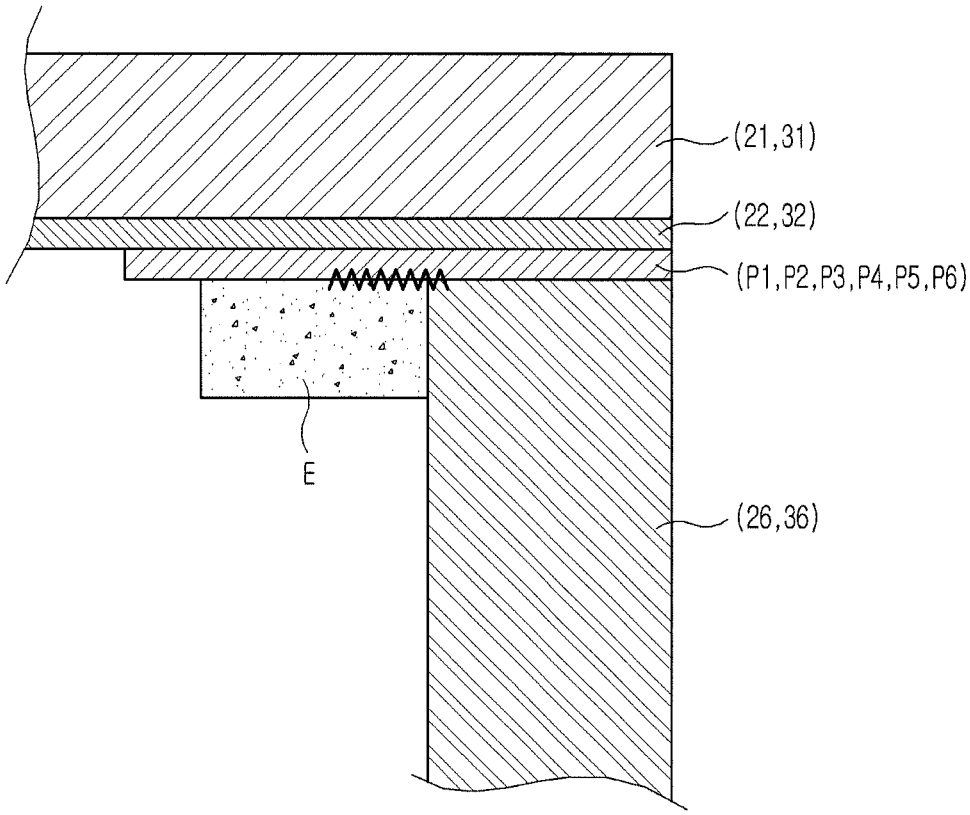
FIG. 7 is a sectional view illustrating the vicinity of the front panel according to example embodiments.

FIG. 7 is a sectional view illustrating the vicinity of the front panel according to example embodiments.

As illustrated in FIG. 7, in example embodiments, the front panels 21 and 31, the printed layers 22 and 32, the release layers P1, P2, P3, P4, P5 and P6, the foamed material E, and the door sashes 26 and 36 may be attached to one another as shown in FIG. 7.

The release layers P1, P2, P3, P4, P5 and P6 are formed on the rear surfaces of the front panels 21 and 31 on which the printed layers 22 and 32 have been formed and then, the door sashes 26 and 36 are coupled to the release layers P1, P2, P3, P4, P5 and P6. Thereafter, a foam solution is directly poured to the rear surfaces of the front panels 21 and 31 to be foamed in a space defined between the release layers P1, P2, P3, P4, P5 and P6 and the door sashes 26 and 36. As the foamed material E is pulled by the door sashes 26 and 36, the foamed material E acts to pull the release layers P1, P2, P3, P4, P5 and P6. Since adhesion of the release layers P1, P2, P3, P4, P5 and P6 to the printed layers 22 and 32 is not as strong as cohesion between the foamed material E and the release layers P1, P2, P3, P4, P5 and P6, the release layers P1, P2, P3, P4, P5 and P6 are peeled off. Consequently, the printed layers 22 and 32 on the rear surfaces of the front panels 21 and 31 are preserved and keep a printed status thereof.

More specifically, conventionally, as a foamed material is pulled toward a door sash, a printed layer adhered to the foamed material is pulled and damaged. However, as a result of printing the release layers P1, P2, P3, P4, P5 and P6 between the printed layers 22 and 32 and the foamed material E, the foamed material E pulled toward the door sashes 26 and 36 acts to pull the release layers P1, P2, P3, P4, P5 and P6 rather than the printed layers 22 and 32, thereby preventing damage to the printed layers 22 and 32.

This is realized by applying the principle of a release agent, which is applied inside a metal mold to allow a molded plastic article to be easily pulled out of the metal mold, according to the example embodiments.

As apparent from the above description, a refrigerator according to example embodiments may be configured such that a release layer is formed on a surface of a printed layer that is provided at a rear surface of a door front panel, thereby preventing peeling of the printed layer.

Although a few embodiments have been shown and described, it should be appreciated by those skilled in the art that changes may be made in these embodiments without departing from the principles and spirit of the disclosure, the scope of which is defined in the claims and their equivalents.

What is claimed is:

1. A refrigerator, comprising:

a body having a storage compartment defined therein; and a door to open and close the storage compartment, wherein the door includes a front panel on a rear surface of which a printed layer is formed, a door sash coupled to the front panel and having at least one opening, and an inner shell defining a part of an inner wall of the storage compartment, wherein a foamed material is charged in a space defined by the front panel, the door sash, and the inner shell, and wherein the front panel includes a release layer formed on a surface of the printed layer to correspond to the contour of the at least one opening, and wherein at least a portion of the release layer is separated from the surface of the printed layer by the foamed material.

2. The refrigerator according to claim 1, wherein the release layer includes a silicon printed portion.

3. The refrigerator according to claim 1, wherein the release layer is provided in and around a rim of the at least one opening.

4. The refrigerator according to claim 1, wherein the door sash contains at least one of acrylonitrile butadiene styrene (ABS) copolymer and aluminum.

5. The refrigerator according to claim 1, wherein the foamed material is formed by foaming a urethane solution.

6. The refrigerator according to claim 1, wherein the front panel contains at least one of reinforced glass and plastic.

7. The refrigerator according to claim 1, wherein:

the storage compartment includes a first storage compartment as an upper storage compartment and a second storage compartment as a lower storage compartment; and the door includes a first door to open and close the first storage compartment and a second door to open and close the second storage compartment.

8. A refrigerator door to open and close a storage compartment, comprising:

a front panel on a rear surface of which a printed layer is formed; and a door sash coupled to the front panel and having a plurality of openings, and an inner shell defining a part of an inner wall of the storage compartment, wherein a foamed material is charged in a space defined by the front panel, the door sash and the inner shell, and wherein the front panel includes a release layer formed on a surface of the printed layer to prevent the printed layer from peeling off caused by the foamed material, and wherein at least a portion of the release layer is separated from the surface of the printed layer by the foamed material.

9. The refrigerator door according to claim 8, wherein the release layer contains silicon.

10. The refrigerator door according to claim 8, wherein the release layer is provided in and around a rim of each of the plurality of openings.

11. The refrigerator door according to claim 8, wherein the door sash contains at least one of acrylonitrile butadiene styrene (ABS) copolymer and aluminum.

12. The refrigerator door according to claim 8, wherein the foamed material is formed by foaming a urethane solution.

13. The refrigerator door according to claim 8, wherein the front panel contains at least one of reinforced glass and plastic.

* * * * *